United States Patent [19]

Kennedy

[11] 4,438,304

[45] Mar. 20, 1984

[54] DOUBLE THROW SNAP ACTION SWITCH

[75] Inventor: Maruice E. Kennedy, Crystal Lake, Ill.

[73] Assignee: Cherry Electrical Products Corporation, Waukegan, Ill.

[21] Appl. No.: 432,250

[22] Filed: Oct. 1, 1982

[51] Int. Cl.[3] ..... H01H 21/40

[52] U.S. Cl. ..... 200/67 D; 200/5 A; 200/339; 200/72 R; 200/159 A

[58] Field of Search ..... 200/67 D, 67 DA, 72 R, 200/159 A, 159 B, 5 A, 275, 339, 340, 67 DB, 5 A

[56] References Cited

U.S. PATENT DOCUMENTS

| | | | |
|---|---|---|---|
| 2,262,777 | 11/1941 | Roper | 200/159 |
| 2,413,130 | 12/1946 | Aitken | 200/67 DB |
| 2,825,778 | 3/1958 | Kelleigh | 200/159 A |
| 3,345,476 | 10/1967 | Russell | 200/72 R |
| 3,590,331 | 6/1971 | Kirsch | 200/159 A X |
| 3,659,163 | 4/1972 | Borisov et al. | 317/249 |
| 3,691,324 | 9/1972 | Brantingson | 200/5 A X |
| 3,916,135 | 10/1975 | Holden et al. | 200/339 |
| 3,941,964 | 3/1976 | Yoder | 200/159 A |
| 3,996,429 | 12/1976 | Chu et al. | 200/5 A |
| 4,029,916 | 6/1977 | Chu | 200/5 A |
| 4,084,071 | 4/1978 | Smith | 200/5 A |
| 4,123,627 | 10/1978 | Boulanger et al. | 200/5 A |
| 4,129,763 | 12/1978 | Murata | 200/159 A |
| 4,200,778 | 4/1980 | Bovio et al. | 200/159 B |
| 4,343,973 | 8/1982 | Main | 200/159 B |

*Primary Examiner*—Stephen Marcus
*Assistant Examiner*—Ernest G. Cusick
*Attorney, Agent, or Firm*—Willian, Brinks, Olds, Hofer, Gilson & Lione Ltd.

[57] ABSTRACT

A snap action double throw switch has a dome-shaped switching element which is responsive to a downward pressure to flex downwardly into conductive contact with an underlying contact element. When pressure is removed, the dome snaps back to a stable position and thereby breaks contact with the contact element. In the stable position a spring arm of the dome element presses the top surface of the dome against an overlying conducting plate.

14 Claims, 6 Drawing Figures

DOUBLE THROW SNAP ACTION SWITCH

TECHNICAL FIELD

The invention relates to double throw switches and more particularly, to such a switch which utilizes a dome-shaped contact element to flex between a first switch contact position and a second switch contact position.

BACKGROUND OF THE INVENTION

Single pole snap action dome or oil can switches have been used to provide reliable electrical switch contacts in relatively low-current apparatus, for example electronic calculators or computers. Such switches have typically utilized a dome-shaped switch element to make and break electrical contact with an associated underlying conducting contact. In its stable or rest state, the dome is supported in spaced relation over the underlying contact. When the dome is pressed, it flexes in a snap action fashion so that a portion of the dome, typically the central portion, presses against the underlying contact and thereby establishes an electrical connection. When pressure is removed from the dome, it snaps back to its rest state and therefore disconnects from the underlying contact.

The above-described dome element may be made of a relatively strong conducting material such as stainless steel. The resiliency of the element is achieved by making the conducting material of the dome sufficiently thin to allow the required flexing movement.

A relatively thin, flexible dome is generally not well suited for high current switching applications, because high current tends to heat and therefore damage the dome. In addition, any arcing such as occurs in high current applications will relatively easily cause damage to the dome.

Many switching applications, for example automotive switching applications, require a compact and reliable switch which operates at relatively high currents. Thus, for example, a switch which operates power windows of an automobile must pass relatively high current to run motors that raise and lower the windows. Such switches must operate in a double throw manner to apply power to operate a window motor when the switch is pressed and to apply a ground signal to maintain the motor in a braked condition when the switch is released.

Although a snap action switch having a dome switching element provides a simple and reliable means for switching, it would no doubt be considered unreliable or undesirable in controlling window motors, because snap action dome switches have heretofore been used in a single throw manner and are typically employed in low current applications.

Accordingly, it is an object of the invention to provide a simple and reliable snap action switch which may be utilized for high current switching applications.

A further object of the invention is to provide such a switch which operates in a double throw manner.

Another object of the invention is to provide a double throw snap action dome switch which defines one switch state when the dome is pressed to flex against an underlying contact and defines a second switch state when the dome is released to snap back to a stable position in contact with an overlying conducting plate.

A further object of the invention is to provide a snap action switch with a dome-shaped switching element which includes one or more flexible spring arms that hold the dome in its stable rest state against a grounded conducting plate and that allow the dome to flex downwardly in response to pressure to move from the grounded plate and against an underlying contact.

BRIEF SUMMARY OF THE INVENTION

In order to achieve the objects of the invention and to overcome the problems of the prior art, the snap action switch of the invention includes a conducting dome-shaped element which flexes between a stable and an unstable switch position. In the stable position a spring arm of the element presses a portion of the dome into contact with an overlying conducting plate. A pushbutton is employed to flex the dome element downwardly to an unstable switch position wherein the dome is disconnected from the overlying plate and is pressed downwardly against an underlying stationary conducting contact. When the pushbutton is released, the dome element flexes back to its stable switch position.

A contact element may be affixed to the center portion of the snap action element, for example by riveting. The snap action contact and underlying stationary contact are dimensioned to pass a desired maximum current.

In one embodiment of the invention the overlying conducting plate of the snap action switch is connected to ground so that the dome element is grounded in its stable position. The underlying contact of the dome is connected to a source of electrical power so that the dome is energized when it is pressed into its unstable switch position.

DETAILED DESCRIPTION OF PREFERRED EMBODIMENTS

Figure 1:
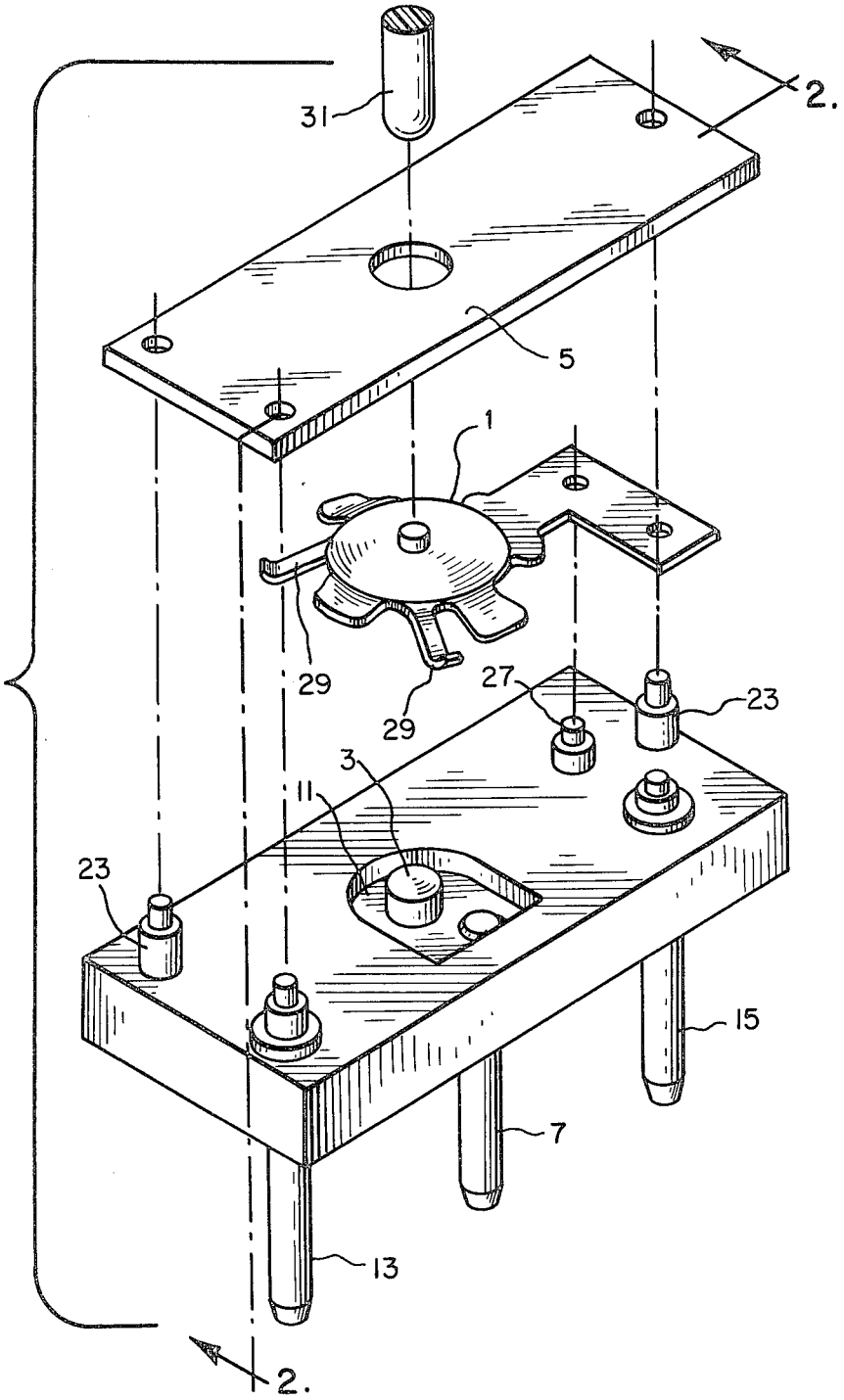
FIG. 1 illustrates an exploded view of an embodiment of a double throw snap action switch.

The remaining portion of the specification will describe preferred embodiments of the invention when read in conjunction with the attached drawings, in which like reference characters designate identical apparatus.

FIG. 1 illustrates an exploded view of the double throw snap action switch of the invention. The illustrated switch is particularly well suited for relatively high current switching applications. For example, the apparatus of FIG. 1 may be employed to control the operation of a motor that raises and lowers a window of an automobile.

The switch of FIG. 1 has a snap action dome-shaped switching element 1 which flexes between an electrically conductive connection with an underlying conducting contact 3 and an overlying conducting plate 5. The snap action switching element 1 may be made of a relatively thin conducting material such as copper-plated steel. However, other materials having suitable conductivity, tensile strength and flexibility may be employed.

The switch of FIG. 1 includes a central terminal pin 7 which passes through an opening in a base 9 that is made of an insulating material, for example plastic. The central terminal pin 7 is conductively connected to the contact 3 by a conducting plate 11 which is integral with the contact 3 and which is conductively connected to the top portion of the terminal pin 7, for example by a staking or riveting process such as is known in the art. Terminal pins 13 and 15 also extend through the insulating base 9 and above the surface of the base to respectively conductively connect with the overlying plate 5 and element 1 by staking or riveting.

Figure 2:
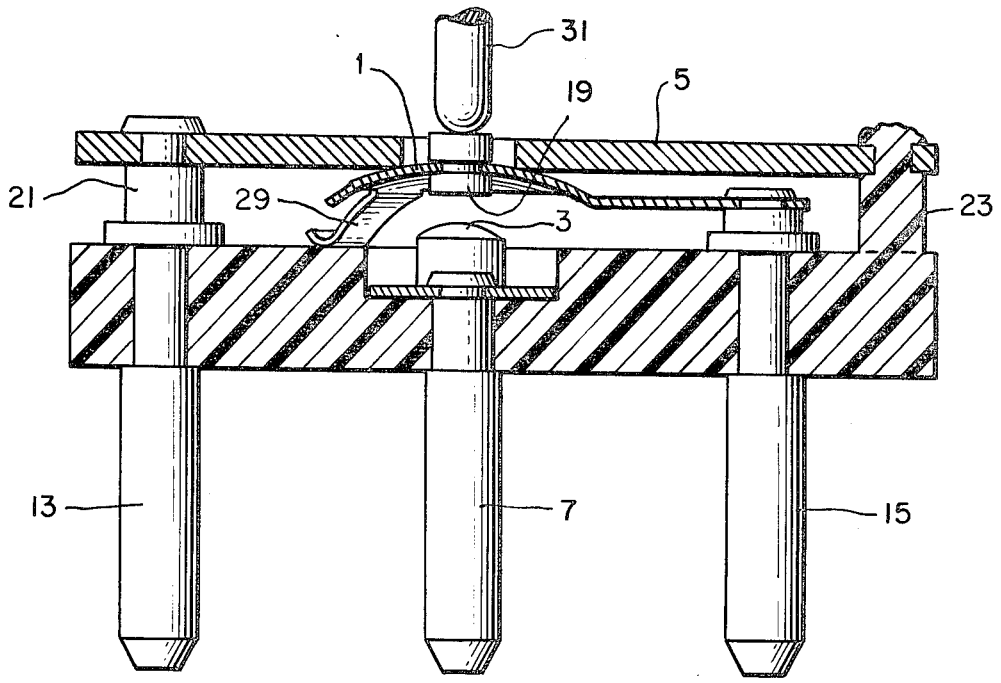
FIG. 2 illustrates a cross-sectional view of the assembled switch of FIG. 1, taken along a line 2—2, with the dome switch element in its rest or stable position.

FIG. 2 illustrates a cross-sectional view of the switch of FIG. 1, taken along a line 2—2. As shown in FIG. 2, when the snap action switching element 1 is in its rest or stable position, a conducting contact 19 of the element 1 is held in spaced relation over the underlying contact 3. The contact 19 of the element 1 is affixed to the element, for example by staking. Thus, the contact 19 is held in conductive contact with the switching element 1, which in turn conductively connected to the terminal pin 15.

The conducting plate 5 is conductively connected to the conducting terminal pin 13 by staking and is held in spaced relation to the base 9 by a spacer portion 21. The plate 5 is also supported above the base 9 by posts 23 that are integral with the base and that are affixed to the plate 5, for example by staking.

As shown in FIG. 1, an additional post 27 is employed to support an end of the switching element 1 so that the switching element forms a cantilever. The switching element 1 is supported by spring legs 29 which press the top portion of the element 1 into electrical contact with the plate 5. The legs 29 are required to provide a firm and reliable electrical contact between the element 1 and the plate 5 when the element 1 is in its rest or stable position.

Figure 3:
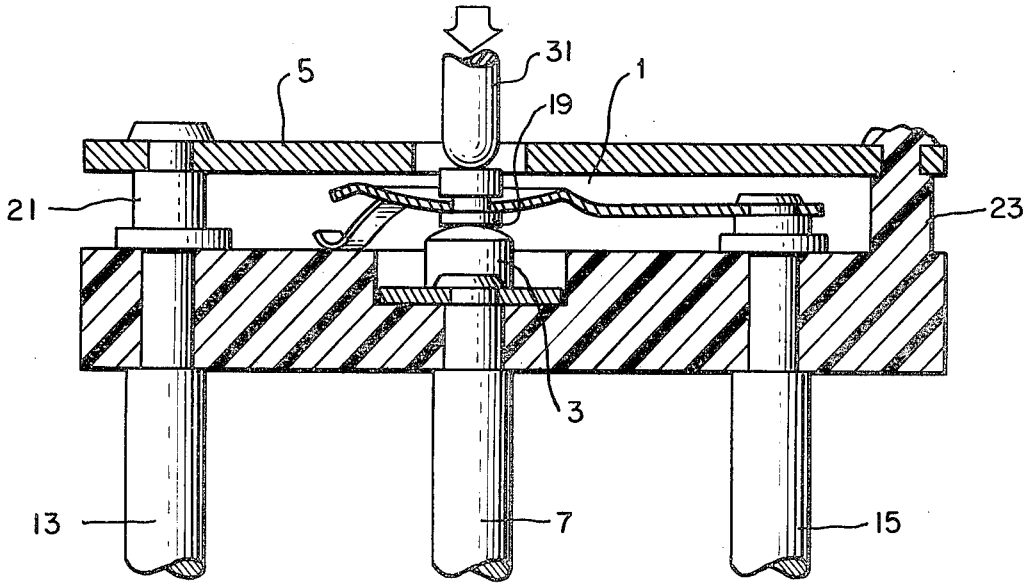
FIG. 3 illustrates a cross-sectional view of the switch of FIG. 1, taken along a line 2—2, with the dome switch element in its depressed or unstable position.

FIG. 3 illustrates a cross-sectional view of the switch of FIG. 1, with the element 1 pressed downwardly by an actuating member 31. As shown in FIG. 3, the actuating member 31 presses downwardly on the snap action switching element 1 until the central portion of the element 1 flexes downwardly in a snapping movement and the contact 19 is thereby pressed against the underlying conducting contact 3. When the switching element 1 is in the downwardly flexed position of FIG. 3, the dome of the element is separated and therefore disconnected from the plate 5.

When the actuating member 31 is pulled away from the switching element 1, the element 1 snaps back to its stable position, as shown in FIG. 2. Thus, the switching element 1 is readily moved between conducting contact with the plate 5 and the underlying contact 3. The switch of FIGS. 1–3 is therefore suitable for operation in environments which require a single pole, double throw switch operation. The relatively heavy duty conducting contacts 3 and 19 are provided so that the switch of FIGS. 1–3 may be employed for relatively high current switching applications, such as for controlling the movement of power windows in an automobile. In such an application, the terminal pin 13 is connected to ground so that the plate 5 forms a ground plane. The terminal 7 is connected to power to provide a power connection for a window motor (not shown). Moreover, a commercially available conducting gel may be provided between the contacts 3 and 19 to reduce or eliminate arcing.

In operation, the element 1 is flexed downwardly to provide a power connection between the central terminal 7 and the terminal pin 15. When the member 31 is released and the element 1 is flexed upwardly, it is strongly held in conductive connection with the plate 5 by the legs 29 and therefore, a ground connection is provided for the pin 15. The ground connection is required in order to provide a brake for the window motor, so that an associated window (not shown) will not drop down when power is disconnected from the motor.

Figure 4:
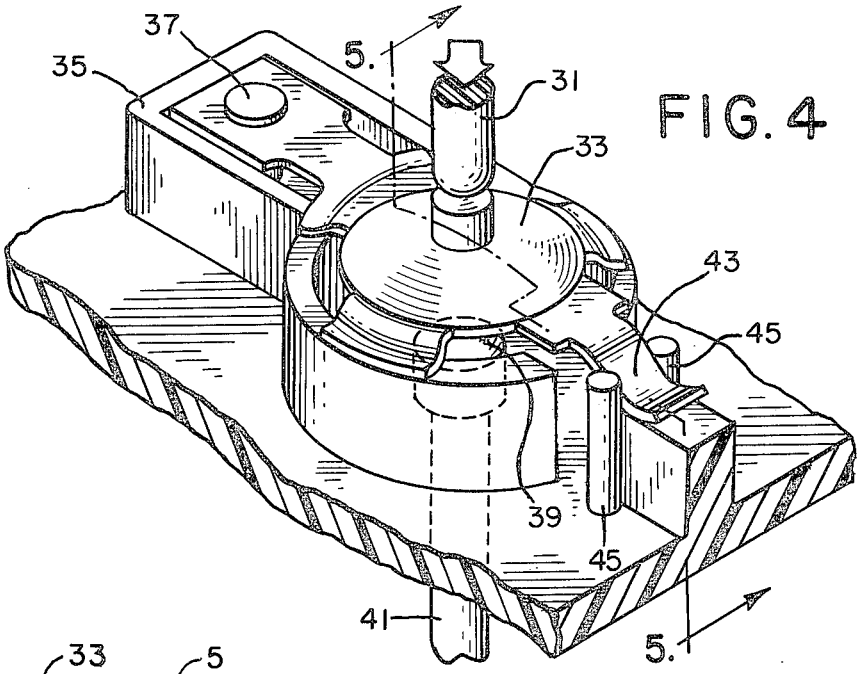
FIG. 4 illustrates a perspective view of an alternative embodiment of a double throw snap action switch having a dome switch element with a single spring arm.

FIG. 4 illustrates an alternative embodiment of a snap action switch. As shown in FIG. 4, a snap action dome-shaped element 33 is held in cantilever relation to an underlying insulated base 35 at a pivot point defined by an upstanding post 37 that is staked over to retain the element 33. The element 33 is positioned so that it overlies a conducting contact 39 which is conductively affixed to a terminal pin 41. As shown in FIG. 4, the conductive interconnection of the terminal pin 41 and contact 39 may be achieved by forming the pin and contact as a single integral element.

The element 33 is shown in FIG. 4 in a rest or stable position that is defined when the element 33 contacts an associated overlying conducting plate (not shown), such as the plate 5 of FIG. 1. The overlying conducting plate for the switching element 33 is removed in FIG. 4 to show the element 33 without obstruction. However, it should be understood that the illustrated positioning of the element 33 can only be achieved when its overlying conducting plate is in place.

Figure 5:
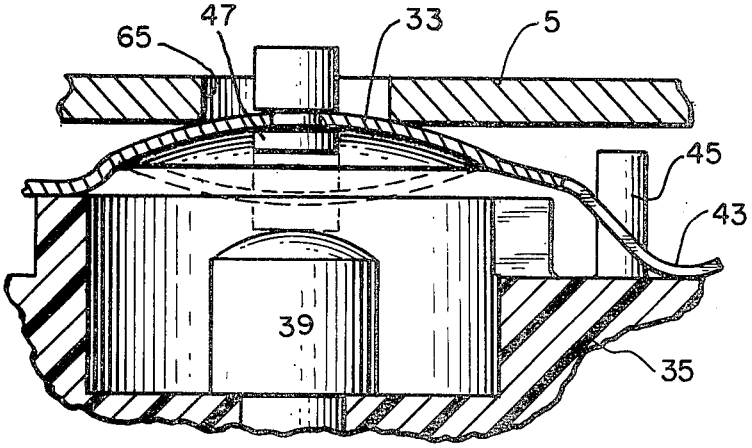
FIG. 5 illustrates a cross-sectional view of a portion of the snap action switch of FIG. 4, taken along a line 5—5.

FIG. 5 illustrates a cross-sectional view of the switching apparatus of FIG. 4, taken along a line 5—5 and with the overlying conducting plate 5 in place. In FIG. 5 the positioning of the element 33 with respect to the base 35 is the same as is illustrated in FIG. 4.

As shown in FIG. 5, the snap action element 33 has a single spring leg member 43 which provides an upward spring force on the element 33 when the element is at its rest or stable position. The upward spring force provided by the leg member 43 ensures that at least a portion of the top surface of the element 33 contacts the overlying terminal plate 5. Posts 45 are formed in the base 35 to slidingly engage the leg member 43 and to thereby maintain the transverse position of the leg member when it flexes in response to the flexing of the element 33.

It should be understood that, as shown in hidden lines in FIG. 5, the actuating member 31 is pressed downwardly to flex the contact 47 of the element 33 against the underlying switch contact 39. Likewise, when the actuating member 31 is released, the snap action element 33 snaps back to the stable position illustrated in solid lines in FIG. 5. The spring leg member 43 therefore maintains contact between the element 33 and plate 5 in the rest position and allows the element 33 to snap downwardly in response to an activating pressure.

Figure 6:
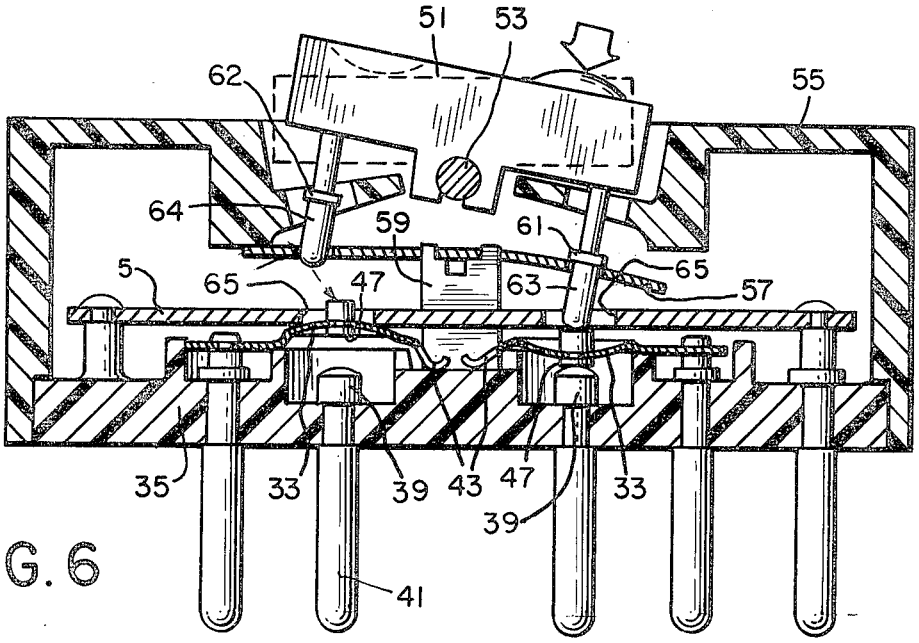
FIG. 6 illustrates a cross-sectional view of a snap action switch having dome switch elements corresponding to the element of FIG. 4.

FIG. 6 illustrates a cross-sectional view of an assembled switch having snap action switching elements 33. In operation, a pushbutton 51 is engaged to pivot about a shaft 53 that is formed in a housing 55 of the switch. The pushbutton 51 is held in a neutral position by a flat spring 57 which is supported by opposite upstanding brackets 59. In the neutral position the ends of the spring 57 contact the underside of the housing 55 and thereby support shoulders 61 and 62 of actuating pins 63 and 64 so that the pushbutton is held in a level horizontal position.

When pressure is applied to the right end of the pushbutton 51, as shown in FIG. 6, the shoulder 61 of the pin 63 presses down against the end of the spring 57 and thereby causes the spring to flex downwardly so that the end of the pin 63 moves through an opening 65 of the conducting plate 5 and presses downwardly on the rightmost snap action element 33. The center portion of the element 33 then snaps down until its contact 47 is pressed against the underlying contact 39.

If the downward force is thereafter removed, the right end of the spring 57 will press against the shoulder 61 of the pin 63 and the pushbutton 51 will therefore be returned to its horizontal or neutral position. The upward movement of the end of the pin 63 will release the depressed rightmost snap action element 33 and will therefore allow the element to snap upwardly into contact with the plate 5. As explained above, the leg member 43 of the dome will hold the dome in conductive contact with the plate 5.

If the pushbutton 51 is pressed downwardly at its left end, the pin 64 will move downwardly to press against the left dome element 33 and will thereby conductively connect the dome element with its underlying contact and associated terminal pin. Of course, when the downward pressure is released, the pushbutton 51 will return to its neutral position and the left dome element 33 will snap back to its contact position with the overlying plate 5.

The switch of FIG. 6 may be employed to control the up and down movement of the window of an automobile. Thus, for example, if the switch is pivoted downwardly to the right, the rightmost element 33 will flex downwardly to provide a power connection which will cause a window motor (not shown) to move its associated window (not shown) upwardly. When the pushbutton 51 is in its neutral position, both of the dome elements 33 will strongly contact the plate 5, which will apply a ground to the domes and will thereby brake the window motor and prevent the window from sliding downwardly. If the pushbutton 51 is rocked to the left, the left dome element 33 will be flexed downwardly to apply power to the motor in a reverse polarity, so that the window will be moved downwardly. Release of the pushbutton 51 will cause the window to be held at a desired level.

The dome switching elements of FIGS. 1–6 have been particularly described with respect to an automotive switching application. However, it should be understood that the invention embodied in the switches of FIGS. 1–6 is not limited to operation for such an application. Thus, the invention may be embodied in other specific forms without departing from its spirit or essential characteristics. The present embodiments are, therefore, to be considered in all respects as illustrative and not restrictive, the scope of the invention being indicated by the claims rather than by the foregoing description. All changes which come within the meaning and range of the equivalents of the claims are, therefore, intended to be embraced therein.

I claim:

1. A snap action switch, comprising:

an electrically conducting terminal plate having at least one aperture formed therethrough;

an electrically conducting stationary contact spaced from said terminal plate;

an electrically conducting contactor means disposed between said terminal plate and said stationary contact, said contactor means including a snap action dome having at least one cantilevered spring arm for supporting the dome in a stable position in spaced relation to said stationary contact and in conductive contact with the terminal plate; and pushbutton means mounted over said terminal plate for engaging said dome through said aperture and flexing the dome away from the terminal plate and against the stationary contact when the pushbutton means is pressed, the dome returning to its stable position when the pushbutton means is released.

2. The snap action switch of claim 1, wherein said at least one cantilevered spring arm is integral with said dome.

3. The snap action switch of claim 1, wherein said dome includes two cantilevered spring arms.

4. The snap action switch of claim 1, wherein said dome includes a conducting contact element for conductively contacting said stationary contact.

5. The snap action switch of claim 1, further including guide means for slidingly engaging said spring arm to block transverse movement of the arm.

6. A snap action switch, comprising:

a plurality of electrically conducting snap action elements, each element shaped to form a convex top side and a concave bottom side;

a plurality of stationary conducting contacts;

means for supporting the concave bottom side of each of said snap action elements in a stable spaced position over an associated one of said stationary contacts;

a conducting plate having a plurality of spaced apertures formed therethrough;

means for mounting the plate over the convex top sides of said elements with each of said apertures disposed above an associated one of said elements;

each of said snap action elements having at least one cantilevered spring arm for pressing the convex top side of the element into conductive contact with said conducting plate in said stable position; and pushbutton means responsive to an actuating force for engaging and depressing the convex top side of said snap action elements through the associated apertures of the plate so that the elements snap downwardly out of contact with the conducting plate and into contact with their associated stationary contacts, the convex top sides of the elements snapping upwardly to their stable positions when the actuating force is removed.

7. The snap action switch of claim 6, wherein said means for supporting includes a flanged ring.

8. A snap action switch, comprising:

at least one actuator means;

means for pivotally supporting said actuator means for rocking movement;

spring means for biasing said actuator means to a neutral horizontal position;

an electrically conducting plate disposed below said actuator means, the plate having at least one aperture formed therethrough;

at least one snap action switching means including:

an electrically conducting stationary contact;

an electrically conducting snap action dome and means for supporting the dome in a stable switch position over and in spaced relation to said stationary contact, said means for supporting including a cantilever spring arm for biasing said dome into conductive contact with said conducting plate when the dome is supported at its stable switch position; and at least one actuator pin carried at one end of said actuator means for pivoting downwardly through the aperture of said plate to flex said dome away from the plate and against the stationary contact.

9. The snap action switch of claim 8, wherein said dome forms a convex top side and a concave bottom side and includes a contact element affixed to its concave bottom side for contacting said stationary contact.

10. The snap action switch of claim 8, wherein said actuator means carries at least one actuator pin at its ends and the snap action switch further includes a snap action switching means for each of said actuator pins.

11. The snap action switch of claim 8, wherein said dome includes an electrically conducting contactor for conductively contacting said stationary contact, the contactor having a thickness sufficient to pass a desired maximum current.

12. The snap action switch of claim 8, wherein said spring means has a hole extending therethrough, said actuator pin extending through the hold to contact said dome, the actuator pin including a shoulder for engaging the spring means to flex one end of the spring means downwardly when said one end of the actuator means is pivoted downwardly, the flexed spring means returning the actuator means to said neutral horizontal position when the actuator means is released.

13. A snap action switch, comprising:

an electrically conducting terminal plate having an aperture formed therethrough;

an electrically conducting contactor means positioned beneath said terminal plate, and adjacent to said aperture, said contactor means having a body portion, a contact element conductively connected to the body portion and means for biasing the body portion into conductive contact with said terminal plate in an area adjacent to said aperture;

an electrically conducting stationary contact disposed beneath said body portion and in spaced relation opposite said contact element when the body portion contacts said terminal plate; and a pushbutton disposed above said terminal plate, said pushbutton having an actuating finger responsive to an actuating force on said pushbutton for engaging said contactor means through said aperture and flexing said contactor means to disengage the body portion from the terminal plate and to conductively connect said contact element and said stationary contact, the body portion flexing to conductively contact said terminal plate and to disengage the stationary contact and contact element when the actuating force is removed.

14. The snap action switch of claim 8, wherein said contactor means includes a snap action dome having at least one flexible arm for resiliently supporting and biasing the dome against said terminal plate.

* * * * *

UNITED STATES PATENT AND TRADEMARK OFFICE

CERTIFICATE OF CORRECTION

PATENT NO. : 4,438,304

DATED : March 20, 1984

INVENTOR(S) : Maurice E. Kennedy

It is certified that error appears in the above-identified patent and that said Letters Patent is hereby corrected as shown below:

On the cover page, after "[75] Inventor:" delete "Maruice" and insert therefor --Maurice--.

In the specification, column 3, line 30, after "which" insert --is--.

In the claims, Claim 14, line 1, delete "8" and insert therefor --13--.

Signed and Sealed this

*Fifteenth* Day of *April 1986*

[SEAL]

*Attest:*

DONALD J. QUIGG

*Attesting Officer*

*Commissioner of Patents and Trademarks*